US009183823B2

(12) United States Patent
McMillen

(10) Patent No.: US 9,183,823 B2
(45) Date of Patent: Nov. 10, 2015

(54) PICKUP AND SUSTAINER FOR STRINGED INSTRUMENTS

(71) Applicant: Kesumo, LLC, Berkeley, CA (US)

(72) Inventor: Keith McMillen, Berkeley, CA (US)

(73) Assignee: Kesumo, LLC, Berkeley, CA (US)

( * ) Notice: Subject to any disclaimer, the term of this patent is extended or adjusted under 35 U.S.C. 154(b) by 276 days.

(21) Appl. No.: 13/804,982

(22) Filed: Mar. 14, 2013

(65) Prior Publication Data

US 2014/0096668 A1 Apr. 10, 2014

Related U.S. Application Data

(60) Provisional application No. 61/711,523, filed on Oct. 9, 2012.

(51) Int. Cl.

| | |
|---|---|
| ***G10H 3/18*** | (2006.01) |
| ***G10H 3/14*** | (2006.01) |
| ***G10H 3/00*** | (2006.01) |

(52) U.S. Cl.

CPC . *G10H 3/18* (2013.01); *G10H 3/00* (2013.01); *G10H 3/143* (2013.01); *G10H 3/146* (2013.01); *G10H 3/181* (2013.01); *G10H 3/185* (2013.01); *G10H 3/186* (2013.01); *G10H 2220/555* (2013.01)

(58) Field of Classification Search

CPC ..... G10H 3/185; G10H 3/18; G10H 3/00
USPC ..... 84/731
See application file for complete search history.

(56) References Cited

U.S. PATENT DOCUMENTS

| | | | | | |
|---|---|---|---|---|---|
| 2,222,057 | A | * | 11/1940 | Benioff | 84/729 |
| 3,595,981 | A | * | 7/1971 | Hopping | 84/726 |
| 4,235,143 | A | * | 11/1980 | Hoexter | 84/726 |
| 4,278,000 | A | * | 7/1981 | Saito et al. | 84/731 |
| 4,567,805 | A | * | 2/1986 | Clevinger | 84/731 |
| 4,750,397 | A | * | 6/1988 | Ashworth-Jones | 84/731 |
| 4,805,510 | A | | 2/1989 | De Dianous | |
| 4,860,625 | A | * | 8/1989 | Mathews | 84/731 |
| 4,867,027 | A | * | 9/1989 | Barbera | 84/731 |
| 4,911,053 | A | * | 3/1990 | Kashio et al. | 84/725 |
| 4,941,388 | A | * | 7/1990 | Hoover et al. | 84/726 |
| 5,078,041 | A | * | 1/1992 | Schmued | 84/731 |
| 5,117,730 | A | * | 6/1992 | Yamauchi | 84/723 |

(Continued)

FOREIGN PATENT DOCUMENTS

| | | |
|---|---|---|
| EP | 1717795 | 11/2006 |
| JP | 30-85600 A | 4/1991 |

(Continued)

OTHER PUBLICATIONS

Young, Diana S., *New Frontiers of Expression Through Real-Time Dynamics Measurement of Violin Bows*, Masters' Thesis, MIT Sep. 2001.

Rasamimanana, Nicolas H., *Gesture Analysis Bow Strokes Using an Augmented Violin*, Technical Report, IRCAM, Jun. 2004.

International Search Report and The Written Opinion of the International Searching Authority dated Jan. 7, 2010, International Application No. PCT/US2009/044382.

International Preliminary Report on Patentability dated Dec. 2, 2010, International Application No. PCT/US2009/044382.

US Office Action dated Feb. 7, 2011, issued in U.S. Appl. No. 12/467,136.

US Notice of Allowance dated Oct. 11, 2011, issued in U.S. Appl. No. 12/467,136.

(Continued)

*Primary Examiner* — David Warren
*Assistant Examiner* — Christina Schreiber
(74) *Attorney, Agent, or Firm* — Weaver Austin Villeneuve & Samspon LLP

(57) ABSTRACT

A bridge pickup for stringed musical instruments is described that incorporates piezoelectric pickups and an integrated magnetic sustain system.

33 Claims, 7 Drawing Sheets

(56) References Cited

U.S. PATENT DOCUMENTS

| | | | | |
|---|---|---|---|---|
| 5,340,941 | A | 8/1994 | Okamoto et al. | |
| 5,378,850 | A * | 1/1995 | Tumura | 84/727 |
| 5,410,101 | A * | 4/1995 | Sakurai | 84/731 |
| 5,585,588 | A * | 12/1996 | Tumura | 84/726 |
| 5,661,253 | A | 8/1997 | Aoki | |
| 6,515,214 | B2 * | 2/2003 | Takabayashi | 84/731 |
| 7,084,337 | B1 | 8/2006 | Schroeder | |
| 7,285,713 | B2 * | 10/2007 | Takabayashi | 84/723 |
| 7,297,864 | B2 | 11/2007 | Ueshima et al. | |
| 7,579,532 | B2 | 8/2009 | Shelton | |
| 7,605,317 | B2 | 10/2009 | Chen et al. | |
| 8,049,095 | B2 * | 11/2011 | Barbera | 84/731 |
| 8,455,749 | B1 * | 6/2013 | Gage et al. | 84/730 |
| 8,981,198 | B2 * | 3/2015 | Nakatani | 84/626 |
| 2002/0069749 | A1 * | 6/2002 | Hoover et al. | 84/738 |
| 2003/0177894 | A1 * | 9/2003 | Skinn | 84/730 |
| 2005/0081703 | A1 * | 4/2005 | Hoover | 84/726 |
| 2005/0257670 | A1 * | 11/2005 | Takabayashi | 84/730 |
| 2009/0308232 | A1 | 12/2009 | McMillen et al. | |
| 2010/0037755 | A1 * | 2/2010 | McMillen et al. | 84/645 |
| 2011/0029009 | A1 | 2/2011 | Dietl | |
| 2012/0210848 | A1 * | 8/2012 | Yamanaka | 84/726 |
| 2013/0074674 | A1 * | 3/2013 | Musel | 84/313 |

FOREIGN PATENT DOCUMENTS

| | | |
|---|---|---|
| JP | 04-085598 | 3/1992 |
| JP | 07-074954 | 8/1995 |
| JP | 10-198363 | 7/1998 |
| KR | 10-2011-0002945 | 1/2011 |
| WO | WO 2014/058546 | 4/2014 |

OTHER PUBLICATIONS

McMillen, K., *Detachable Polyphonic Pickup for Bowed Stringed Instruments*, Abstract, BEAM Foundation, www.beamfoundation.org.

Rossing, Thomas D., *The science of string instruments*, Springer, Dec. 10, 2010, 470 pgs. Abstract.

Smits, J. G. et al., *The constituent equations of piezoelectric heterogenous bimorphs*; Ultrasonics, Ferroelectrics and Frequency Control, IEEE Transactions; May 1991, vol. 38, Issue 3, pp. 256-270 Abstract.

Meyer, Ryan Michael, *Enhancement of single-lap joint strength under tension using piezoelectric actuation*, Thesis—Louisiana State University and Agricultural and Mechanical College, May, 2010 Abstract.

Smits, J. G. et al., *The constituent equations of piezoelectric bimorphs*, Ultrasonic Symposium, 1989. Proceedings, IEEE 1989, Boston University Oct. 3-6, 1989, vol. 2, pp. 781-784 Abstract.

McPherson, A., *Augmenting the acoustic piano with electromagnetic string actuation and continuous key position sensing*, Electronics and Computer Engineering, Drexel University Abstract.

Loock, H.-P., et al., *Recording the sound of musical instruments with FBGs*: The photonic pickup, Journal: Applied Optics, May 10, 2009, vol. 48, No. 14, pp. 2735-2741 Abstract.

PCT International Search Report and Written Opinion dated Jan. 30, 2014 issued in Application No. PCT/US2013/058274.

* cited by examiner

PICKUP AND SUSTAINER FOR STRINGED INSTRUMENTS

RELATED APPLICATION DATA

The present application claims priority under 35 U.S.C. 119(e) to U.S. Provisional Patent Application No. 61/711,523 entitled Pickup and Sustainer System for Stringed Instruments filed on Oct. 9, 2012, the entire disclosure of which is incorporated herein by reference for all purposes.

SUMMARY

According to a particular class of implementations, a saddle component is provided for mounting on a surface of a stringed instrument and securing an end of a string of the stringed instrument. The saddle component has a body having a cantilevered structure extending therefrom. The cantilevered structure is configured to receive the string and to mechanically vibrate with a primary mode of vibration of the string in a direction parallel to the surface of the stringed instrument. The cantilevered structure further comprising a bimorph piezoelectric element oriented such that a primary planar orientation of the bimorph piezoelectric element is substantially perpendicular to the surface of the stringed instrument and substantially parallel to the string.

According to a specific implementation, the saddle component of claim 1 includes a permanent magnet in the cantilevered structure, and an electromagnet configured to interact with the permanent magnet to cause corresponding mechanical motion of the cantilevered structure. According to a more specific implementation, the saddle component has an associated signal processor configured to receive an electrical signal generated by the bimorph piezoelectric element and generate a drive signal for the electromagnet responsive to the electrical signal.

According to another specific implementation, the saddle component includes a permanent magnet in the cantilevered structure, and an electromagnet. The magnetic field of the permanent magnet interacts with the electromagnet during mechanical motion of the cantilevered structure, thereby causing the electromagnet to generate an electrical signal. According to a more specific implementation, the saddle component has an associated signal processor configured to receive the electrical signal generated by electromagnet and generate a drive signal for the bimorph piezoelectric element responsive to the electrical signal.

According to yet another specific implementation, the saddle component has an associated signal processor configured to receive an electrical signal generated by the bimorph piezoelectric element and generate a drive signal for the bimorph piezoelectric element responsive to the electrical signal, thereby causing corresponding mechanical motion of the cantilevered structure.

According to another class of implementations, a transducer is provided for converting mechanical vibration of a string of a stringed instrument to an electrical signal. The transducer has a body having a cantilevered structure extending therefrom. The cantilevered structure is configured to receive the string and to mechanically vibrate with a primary mode of vibration of the string. The cantilevered structure includes a bimorph piezoelectric element that is oriented such that a primary planar orientation of the bimorph piezoelectric element is substantially perpendicular to a plane defined by the primary mode of vibration of the string, and substantially parallel with the string. The bimorph piezoelectric element is configured to generate the electrical signal in response to the vibration of the string and the cantilevered structure.

According to a specific implementation, the transducer includes a permanent magnet in the cantilevered structure, and an electromagnet configured to interact with the permanent magnet to cause corresponding mechanical motion of the cantilevered structure. According to a more specific implementation, the transducer has an associated signal processor configured to receive the electrical signal generated by the bimorph piezoelectric element and generate a drive signal for the electromagnet responsive to the electrical signal, thereby causing the corresponding mechanical motion of the cantilevered structure.

According to another specific implementation, the transducer has an associated signal processor configured to receive the electrical signal generated by the bimorph piezoelectric element and generate a drive signal for the bimorph piezoelectric element responsive to the electrical signal, thereby causing corresponding mechanical motion of the cantilevered structure.

According to yet another class of implementations, a sustain component is provided for mounting on a surface of a stringed instrument and securing an end of a string of the stringed instrument. The sustain component has a body having a cantilevered structure extending therefrom. The cantilevered structure is configured to receive the string and to mechanically vibrate with a primary mode of vibration of the string in a direction parallel to the surface of the stringed instrument. The sustain component also includes a permanent magnet in the cantilevered structure, and an electromagnet configured to interact with the permanent magnet to cause corresponding mechanical motion of the cantilevered structure to sustain the primary mode of vibration of the string.

According to a specific implementation, the sustain component has an associated signal processor configured to receive an electrical signal generated by the electromagnet and generate a drive signal for the electromagnet responsive to the electrical signal, thereby causing the corresponding mechanical motion of the cantilevered structure.

A further understanding of the nature and advantages of the present invention may be realized by reference to the remaining portions of the specification and the drawings.

DETAILED DESCRIPTION

Figure 1A:
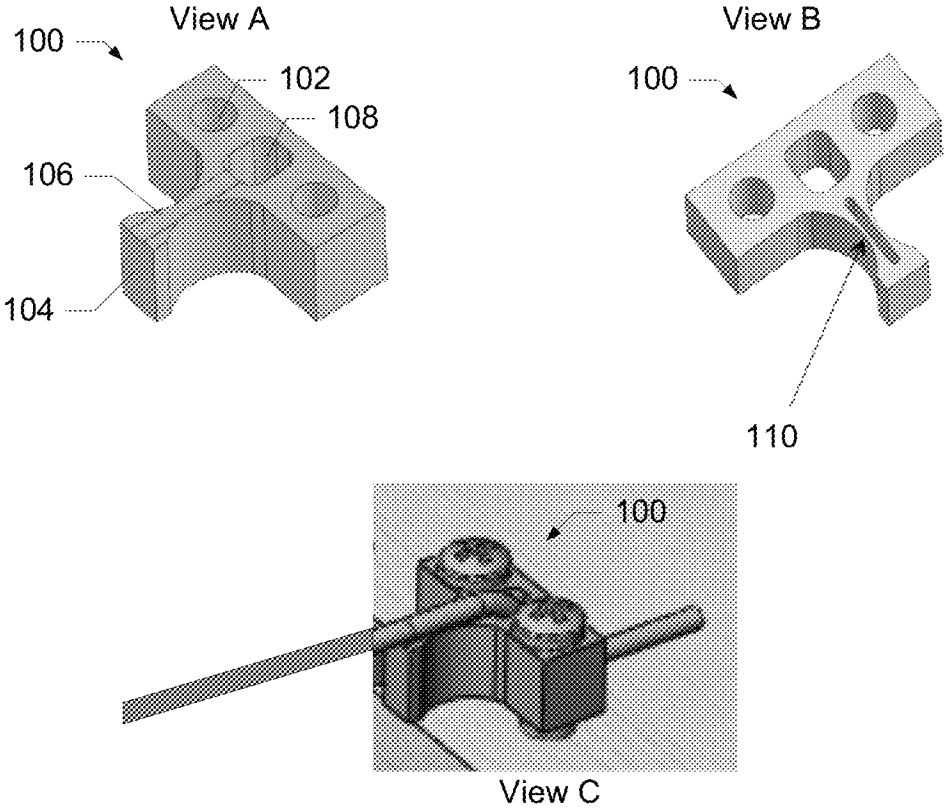
FIG. 1A shows three views of a particular implementation of a saddle component for implementing a pickup for stringed instruments.

Reference will now be made in detail to specific embodiments of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims. In the following description, specific details are set forth in order to provide a thorough understanding of the present invention. The present invention may be practiced without some or all of these specific details. In addition, well known features may not have been described in detail to avoid unnecessarily obscuring the invention.

A bridge pickup for stringed musical instruments is described that incorporates piezoelectric pickups and an integrated magnetic sustain system. A particular implementation for guitars described below detects the vibrations of each individual guitar string with a corresponding bimorph piezoelectric element, and drives the individual strings using electromagnetic feedback to sustain plucked notes. As will become apparent, some implementations have dimensions that allow the retrofitting of Fender-style guitars (e.g., Stratocasters and Telecasters). As will also be appreciated, the innovations represented by the pickup and sustain components described herein may be applied separately and in combination to a wide variety of stringed instruments.

According to a particular class of implementations for guitars, the bridge of the guitar has six saddle components (one for each string), each including a piezoelectric element configured to transduce string vibrations into electrical signals. Because each saddle component has its own piezoelectric element pickup, the signals from the individual strings are substantially electrically isolated and can be amplified separately. This may, in turn, enable a wider breadth of timbral control, effects processing configurations, and signal analysis than with a traditional monophonic electric guitar. For example when distorting a guitar signal (a common effect) the monophonic guitar will produce IM (Inter Modulation) distortion that can be very harsh. Distorting each string individually eliminates this problem. Analyzing one string for pitch and amplitude information is much easier than trying to extract this information from a pickup signal where many strings are combined.

Each saddle component includes a cantilevered structure (e.g., a flexing beam) that is or contains a bimorph piezoelectric element, the primary plane of which is oriented substantially perpendicular to the top surface of the instrument, and substantially parallel with the corresponding guitar string. As such, each piezoelectric element is particularly sensitive to the motion of the corresponding guitar string that is parallel to the top plane of the guitar, thereby enabling efficient capture of the primary mode of the string's vibration while exhibiting lower responsiveness to movement in other directions.

By "listening" to the string at the bridge in the plane of the string's primary mode of vibration (and for implementations including a sustainer, driving the string in that same direction) many problematic phase issues associated with other pickups (and sustainers) are eliminated. And because vibrations in other directions are significantly attenuated because of the orientation of the piezoelectric element, the body rumble or spring noise associated with most vibrato style bridges may be significantly reduced.

This is to be contrasted with conventional bridge pickups that use a piezoelectric element for each string, the plane of which is parallel to the top surface of the instrument and which is therefore primarily sensitive to changes in string tension. In such a conventional configuration, the tension changes twice for each cycle of the string, resulting in a pickup output that does not faithfully capture the fundamental frequency of the plucked note and therefore sounds tinny or shrill. On the other hand, implementations such as those described herein more effectively capture the string's fundamental, thereby producing a richer sonic output.

FIG. 1A shows three views of an example of saddle component 100 that is configured to include a bimorph piezoelectric element but not an integrated sustainer. View A is a top perspective view that shows the through-holes 102 by which saddle component 100 is secured to the bridge of the instrument. In this example, flexing beam 104 has a groove 106 in which the instrument string rests before being routed through aperture 108 through which the end of the string is secured as shown in View C. View B is a bottom perspective view of saddle component 100 which shows the slot or cavity 110 in the underside of flexing beam 104 in which the bimorph piezoelectric element (not shown) resides.

Figure 1B:
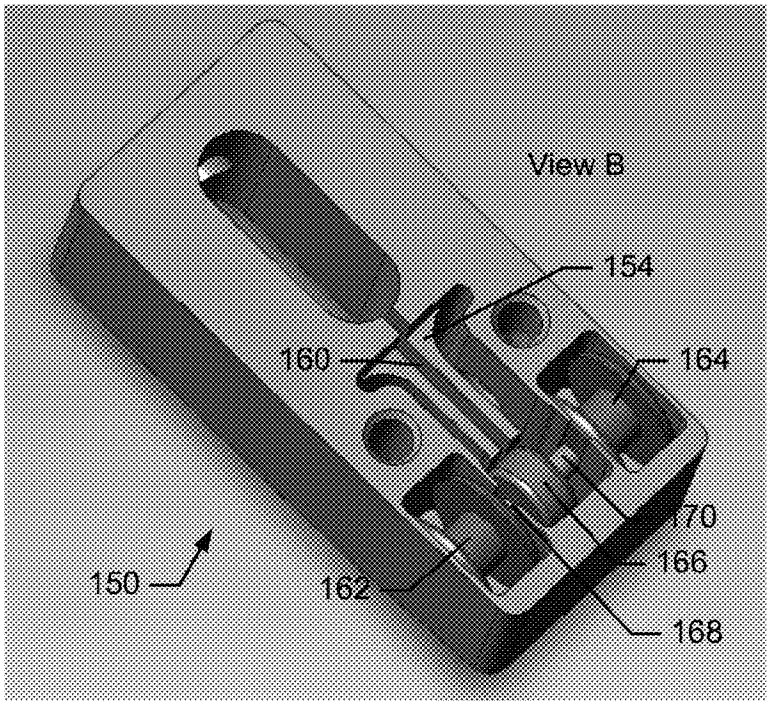
FIG. 1B shows two views of another particular implementation of a saddle component for implementing a combined pickup and sustainer for stringed instruments.
Figure 1B:
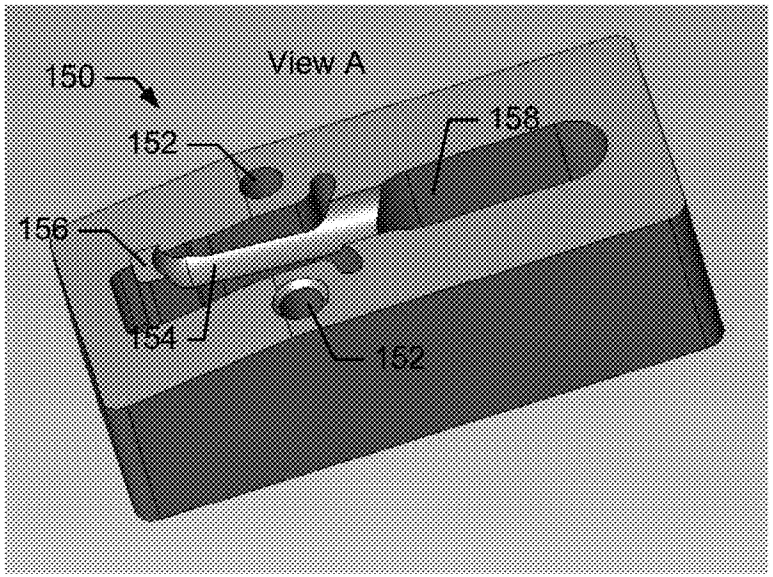

FIG. 1B shows two perspective views of another saddle component 150 configured to include a bimorph piezoelectric element and an integrated sustainer. View A is a top perspective view that shows the through-holes 152 by which saddle component 150 is secured to the bridge of the instrument. In this example, flexing beam 154 has a curved lip 156 over which the instrument string is routed before being routed through aperture 158 through which the end of the string is secured. View B is a bottom perspective view of saddle component 150 which shows the slot or cavity 160 in the underside of flexing beam 154 in which the bimorph piezoelectric element (not shown) resides. Also shown are two bobbins 162 and 164 in cavities on either side of a cavity in which permanent magnet 166 is secured to flexing beam 154. Bobbins 162 and 164 hold windings (not shown) which form electromagnets with cores 168 and 170. As will be discussed below (e.g., with reference to FIGS. 3 and 4), the magnetic fields generated by the electromagnets interact with the magnetic field of permanent magnet 166 to sustain the string's vibration and/or facilitate any of a variety of other functions or effects.

As is well known, piezoelectric materials convert mechanical energy to electrical energy or vice versa. A bimorph piezoelectric element is a piezoelectric element having two piezoelectric layers such as, for example, the cantilever mounted piezoelectric element 200 shown in FIG. 2. The application of mechanical stress, e.g., bending, to such a 2-layer element results in electrical charge generation that depends on the direction of the force, the direction of polarization, and the wiring of the individual layers. When a mechanical force causes a suitably polarized 2-layer element to bend, one layer (e.g., layer 202) is compressed and the other (e.g., layer 204) is stretched. Charge develops across each layer in an effort to counteract the imposed strains. According to particular implementations described herein, it is the primary mode of a string's vibration that causes bending of a piezoelectric element similar to the bending illustrated in FIG. 2.

Figure 2:
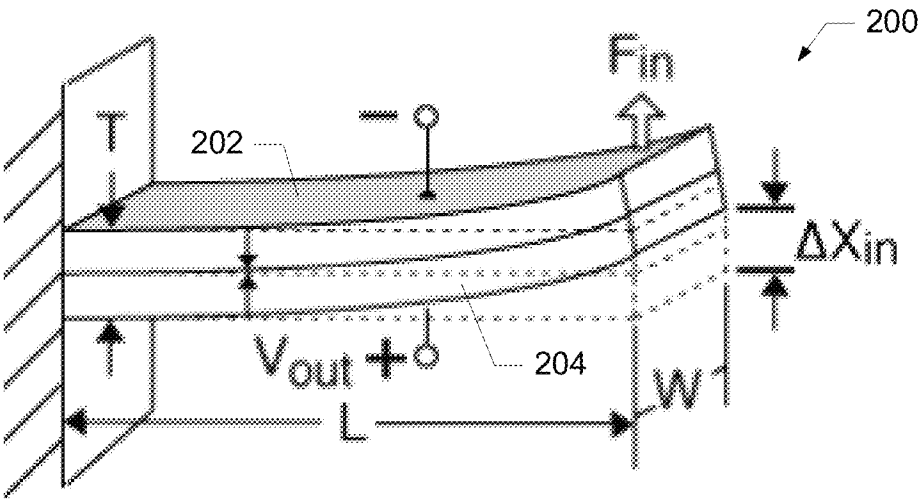
FIG. 2 illustrates a bimorph piezoelectric element for use with particular implementations.

Referring back to FIGS. 1A and 1B, flexing beams 104 and 154 are configured such that their greatest degree of mechanical freedom is in the direction of the primary mode of the string's vibration, and such that this motion will cause the bimorph piezoelectric element in cavity 110 or 160 to deform from its primary planar orientation back and forth along with the string (e.g., as shown in FIG. 2), thereby enabling capture of the string's primary mode of vibration.

According to the class of embodiments of which component 150 FIG. 1B is a representative example, each saddle component for each string includes an integrated sustainer.

More specifically, the flexing beam of each saddle component includes or is connected to one or more permanent magnets that are driven by one or more electromagnets. When the sustainer is enabled, the electrical signal from a piezoelectric pickup (e.g., as described above) is routed through a signal processing chain (e.g., that may include some or all of fundamental detection, band-pass filtering, latency compensation, transient amplitude generator, compression, limiting, etc.) and a power amplifier. The resulting signal is then sent to the electromagnet(s) as a drive signal which sympathetically drives the string (through the interaction of magnetic fields of the electromagnet(s) and the permanent magnet associated with the flexing beam) and sustains the note.

Unlike other guitar sustainers, this approach can be employed to drive each string independently and may be employed with advanced digital signal processing (DSP) techniques to ensure that the drive signal is in phase with the pickup signal, yielding maximally efficient sustain and avoiding phase-cancellation issues. According to some implementations, the individual string signals may be processed using a StringPort, a hardware and software bundle for polyphonic instruments from Keith McMillen Instruments various characteristics of which are described in U.S. Patent Publication No. US 2010/0037755, the entire disclosure of which is incorporated herein by reference for all purposes. In addition, the integration of the sustainer with processing on the StringPort host processor facilitates the implementation of more complex sonic effects and signal modulation than other standalone sustainer systems on the market.

Figure 3:
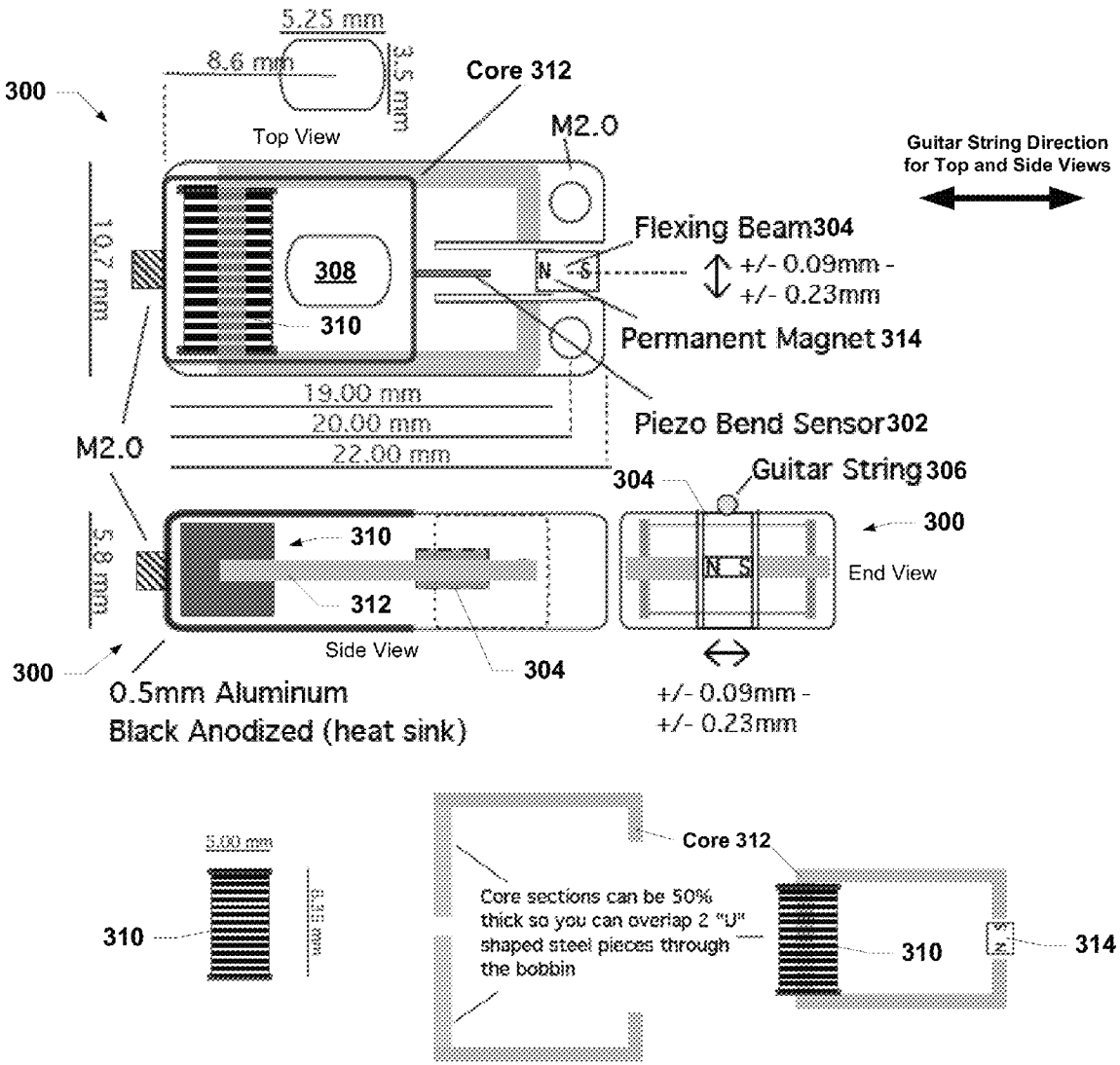
FIG. 3 provides various views of a particular implementation of a combined pickup and sustainer for stringed instruments.

FIG. 3 shows different views and components of a saddle component 300 which integrates a bimorph piezoelectric pickup and a sustainer in a Fender-style package. As with saddle components 100 and 150 of FIGS. 1A and 1B, saddle component 300 includes a bimorph piezoelectric element 302 within a flexing beam 304. According to a particular implementation, piezoelectric element 302 may be constructed from two layers of piezoelectric plate material glued together with a thin brass or other metal plate between the layers. These materials are readily available from many manufacturers. In the depicted implementation, piezoelectric element 302 has a rectangular dimensions of about 4 mm×2 mm.

The instrument string 306 (e.g., a guitar string) is routed over the top of flexing beam 304 (as shown in the End View) and down through aperture 308 for securing to the instrument. Again, it will be appreciated that flexing beam 304 (and therefore piezoelectric element 302) moves with the primary mode of the string's vibration parallel to the top of the instrument. The main body of saddle component 300 may be constructed from glassed filled nylon or an engineering thermoplastic such as, for example, Delrin. Saddle component 300 (as well as others of the saddle components described herein) may be coated as shown with a heat sink material (e.g., anodized aluminum) which may, for example, be put into a mold for the saddle component before injection of the nylon or thermoplastic.

Saddle component 300 also includes an electromagnet having a winding 310 and a core 312 (e.g., a silicon steel core) that extends around the perimeter of the saddle component and on either side of a permanent magnet 314 in flexing beam 304. According to a particular implementation, permanent magnet 314 is a 2 mm×2 mm cylinder having a magnetic field of greater than about 2200 gauss (with poles on the flat end of the cylinder), with air gaps of about 0.25 mm being provided on either side of flexing beam 304. And as shown in, for example, the End View of FIG. 3, permanent magnet 314 may be oriented with the poles adjacent the opposing elements of core 312. Alternatively, the orientation of permanent magnet 314 may be rotated 90 degrees from that orientation as shown, for example, in the Top View of FIG. 3, as long as one of the poles is sufficiently within the field generated by the electromagnet.

As described below with reference to FIG. 5, the electromagnet can be driven with a signal derived from piezoelectric element 302 and, through its interaction with permanent magnet 314, cause flexing beam 304 to vibrate in such a way to cause the string to sustain its vibration. As shown in FIG. 3, a particular implementation of core 312 includes two pieces with the core sections that go inside the bobbin on which winding 310 is wound being half as thick as the rest of the core pieces so that they may overlap inside the bobbin.

As will be understood, it is desirable to design the flexing beam of the saddle component to optimize string stability while allowing motion parallel to the top surface of the instrument. The motion required to keep the string vibrating is a typically in the range of a few hundred microns. The more flexible the beam, the easier it will be to drive with the magnetic components or other approaches. However if the beam is too flexible it will cause the string's harmonics to vary from true (harmonics normally are whole number ratios of the string's fundamental frequency). These variations becomes more obvious at higher notes on the string as the string becomes shorter with respect to the beam and any deviant motion of the beam will become more dominant. According to a particular implementation of saddle component 300, the displacement of flexing beam 304 sufficient to support a sustain for any of a guitar's strings is about ±90 microns which requires the drive to the electromagnet to be about 0.675 Watts rms. According to this implementation, a displacement of about ±230 microns may be achieved with a drive of about 1.944 Watts rms.

Fixing the beam's motion so that it is primarily parallel to the top of the instrument will restrict certain deviant motions. This can be accomplished by the design of the beam cross-section, and/or using stiffeners that give the beam freedom in the parallel plain but restrict motion in the vertical plain perpendicular to the top of the instrument. Other methods to stabilize the beam may include the use of soft damping materials that reduce motion of the beam below the string's fundamental. Still other methods may involve using the sustainer's drive system to stabilize the beam. For example, normal drive operation is focused on driving the beam at the pitch or some harmonic of the played note. In addition to this, false harmonics can be analyzed by the system's DSP to find the fundamental and to drive the beam in a manner that forces the harmonics to remain substantially true to the whole number ratio.

Figure 4:
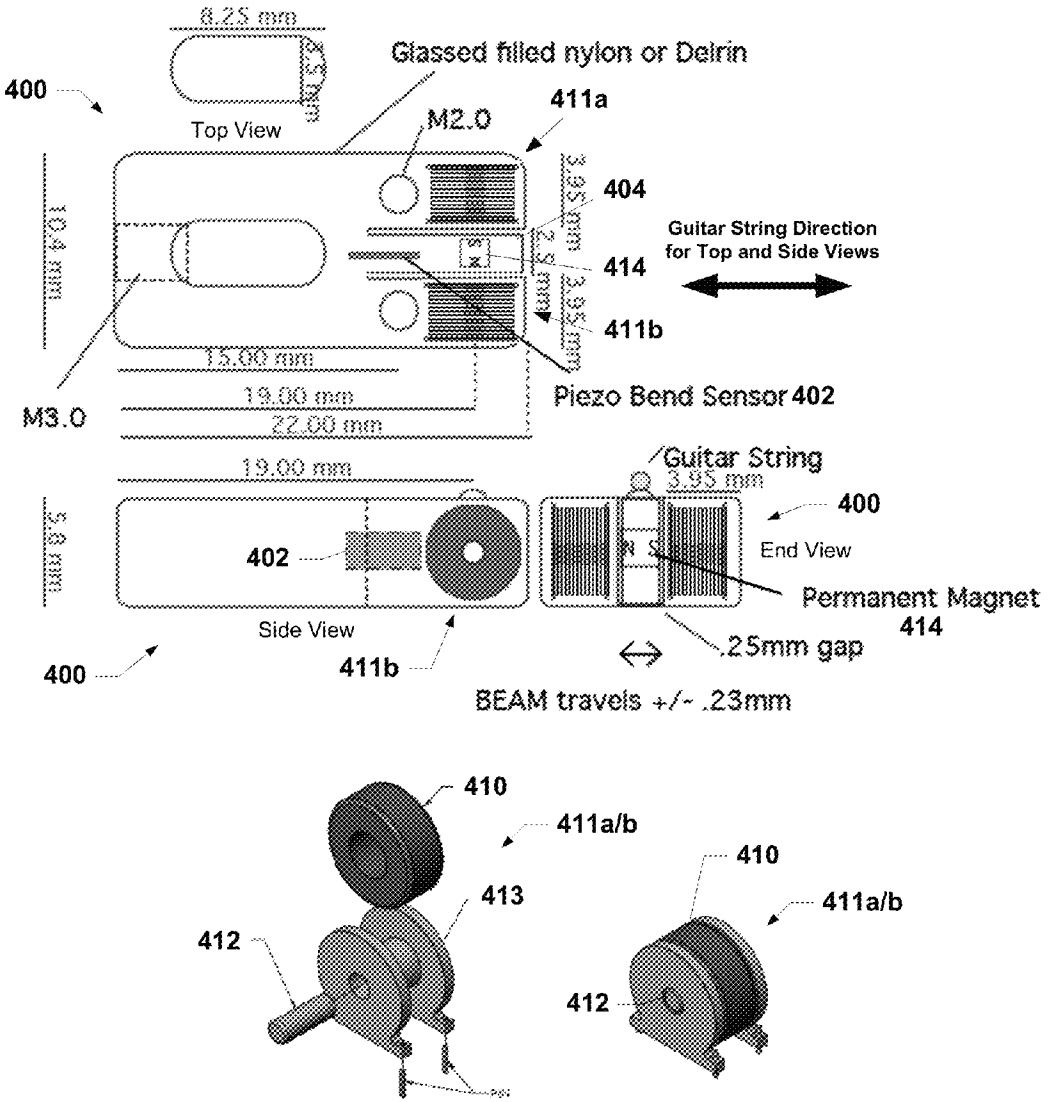
FIG. 4 provides various views of another implementation of a combined pickup and sustainer for stringed instruments.

FIG. 4 shows an alternative implementation of a saddle component 400 in which two electromagnets 411*a* and 411*b* act on permanent magnet 414 to achieve the sustain function. As with saddle component 300, saddle component 400 includes a bimorph piezoelectric element 402 as or in flexing beam 404 to generate a pickup signal representing the string's vibration. According to a particular implementation, the coils of the electromagnets may be driven out of phase with each other to simultaneously have one electromagnet push the permanent magnet while the other electromagnet pulls the permanent magnet, thereby increasing the efficiency of the system.

According to a particular implementation, piezoelectric element 402 may be constructed as described above with reference to FIG. 3. Permanent magnet 414 is a 1.5 mm×1.5 mm cylinder having a magnetic field of greater than about 6000 gauss (with poles on the flat end of the cylinder), with air gaps of about 0.25 mm being provided on either side of flexing beam 404. According to this implementation of saddle component 400, the displacement of flexing beam 404 sufficient to support a sustain for any of a guitar's strings is about ±90 microns which requires the drive to the electromagnet to be about 0.675 Watts rms. According to this implementation, a displacement of about ±230 microns may be achieved with a drive of about 1.944 Watts rms.

Also according to this implementation, electromagnets 411*a* and 411*b* include a winding 410 and a core 412. Winding 410 is about 1000 turns of 46 AWG copper wire around bobbin 413 which is secured within the main body of saddle component 400 (e.g., as shown in FIG. 1B). Core 412 may be soft annealed iron and have a diameter of about 1.0 mm to 1.15 mm.

Figure 5:
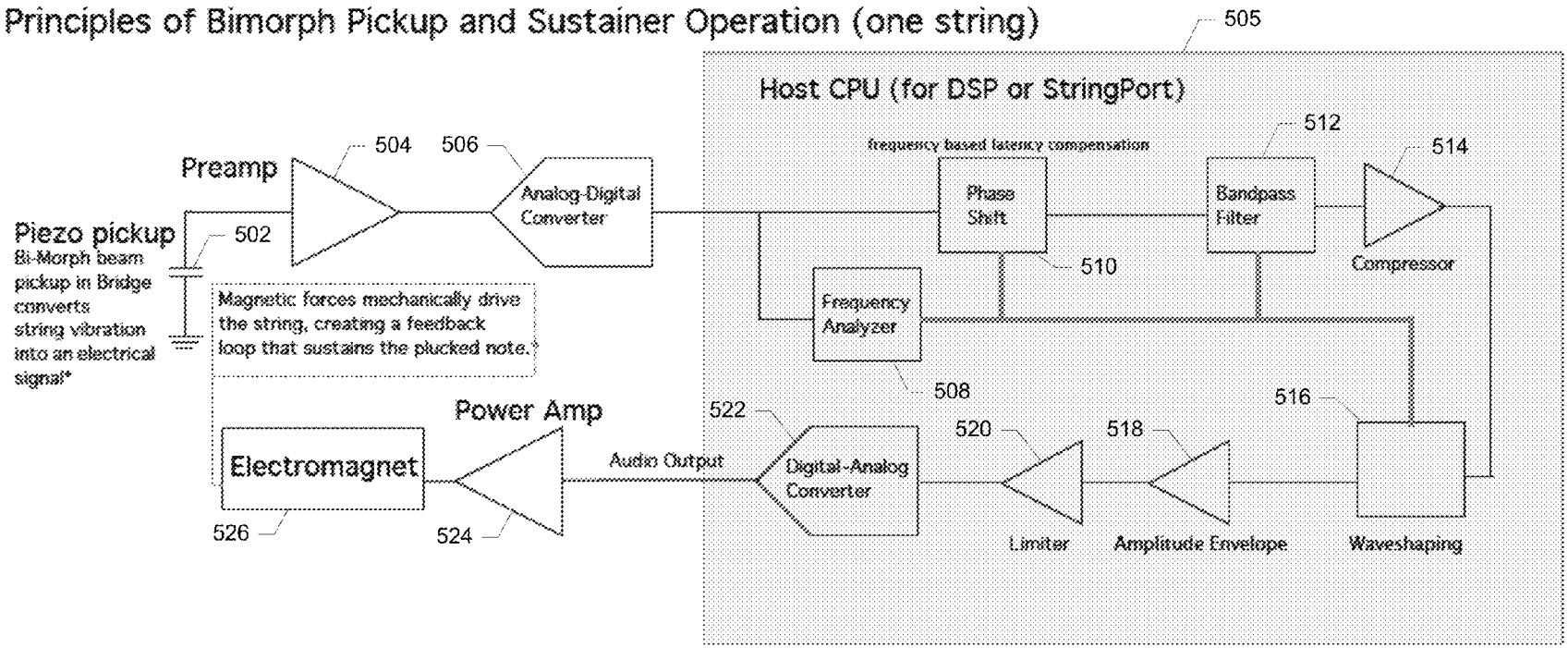
FIG. 5 is a block diagram illustrating operation of a particular implementation of a combined pickup and sustainer for stringed instruments.

FIG. 5 shows an example of a signal processing chain that may be employed by various implementations to use the pickup output generated by a bimorph piezoelectric element (e.g., as described above) to drive an electromagnet to provide a sustain function or any of a variety of other functions or effects. The diagram of FIG. 5 illustrates the signal processing chain for one string of an instrument, but it will be understood that the components and/or functional blocks for depicted chain may be reproduced for each string of an instrument.

A bimorph piezoelectric element 502 is a high-impedance capacitive source and so is represented in FIG. 5 as a capacitor. A preamp 504 buffers the signal from element 502 so that it can be converted into the digital domain for processing by Host CPU 505 by an analog-to-digital converter (ADC) 506. Host CPU 505 may be any of a wide variety of digital signal processors or controllers suitable for providing the processing capabilities and functionalities described herein, may be integrated with or remote from the stringed instrument, and may be implemented in hardware, software, firmware, or any combination thereof. For example, Host CPU 505 may be a StringPort as mentioned above. Alternatively, Host CPU 505 may be implemented using one or more microprocessors, one or more application-specific integrated circuits, one or more field-programmable gate arrays, or any suitable type of device; each of which may be onboard or remote from the stringed instrument.

It should also be noted that any computer program instructions or code with which embodiments of the invention may be implemented may correspond to any of a wide variety of programming languages, software tools, data formats, or codecs, may be stored in any type of volatile or nonvolatile, non-transitory computer-readable storage medium or memory device, and may be executed according to a variety of computing models without departing from the scope of the invention.

Referring again to FIG. 5, a frequency analyzer 508 determines the fundamental of the string's vibration. This is useful for adjusting the stages in the processing chain that are frequency dependent. And because this is a discrete time system there is a propagation delay which may be adjusted (phase shift 510) so that the final analog output is in phase with the signal from the pickup. It will be understood that, since the plane of vibration of acceptance of the pickup is substantially the same as the plane in which the string is primarily driven, there would be no need for control of phase if, as is contemplated for some implementations, the system is mostly or entirely analog where propagation delays may be ignored.

Bandpass filter 512 is centered on the fundamental frequency as determined by frequency analyzer 508. According to a particular implementation, bandpass filter 512 is designed to yield primarily a sine wave at the string's fundamental. Compressor 514 is designed to maintain the signal at a minimum level as the sustainer starts to drive the string. The drive signal may be shaped (e.g., waveshaping 516) to provide drive with desired harmonic content. For example, an additional 2nd harmonic may provide a "smoother" sound while an additional 3rd harmonic can give an "edgier" sound.

It may be desirable to control the level of or otherwise manipulate the drive signal (e.g., amplitude envelope 518) to achieve specific effects. For example, adding a transient to the beginning of the drive signal helps the onset of sustain. In another example, adjusting the drive signal based on initial string loudness can provide sustain at various dynamic levels. In another example, a long decay can be programmed to provide a "natural" sounding decay of the string but much longer than the string could provide without the sustain mechanism. A limiter 520 protects digital-to-analog converter (DAC) 522 from clipping and introducing distortion into power amp 524 which drives electromagnet 526.

A vibrating string is a high Q system that continues to vibrate even in the absence of drive with a known decay time. Therefore, implementations are contemplated in which a string is driven less than 100% of the time during which a sustain is desired. For example, the drive may be periodic with a duty cycle below 100%. Such implementations are particularly desirable where conserving power is important, e.g., battery powered systems. According to a particular implementation, an amplitude modulation scheme is implemented on the drive signal to reduce average current consumption. A variety of approaches may be employed and may be as simple as skipping every other drive period based on the string's frequency, or more sophisticated as in ramping the drive periods up to full level, holding full level, ramping down and pausing before repeating. Parameters such as, for example, the string's frequency, resonance of the guitar body, and driving power of the sustain mechanism will inform suitable approaches for a given application. According to another implementation, the drive times of the respective strings may be synchronized to balance power consumption. For example if we are driving each of the 6 strings for 40 milliseconds every 240 milliseconds the drive periods for the different strings can be spaced so that no 2 drive periods are occurring simultaneously thereby minimizing peak current consumption.

Figure 6:
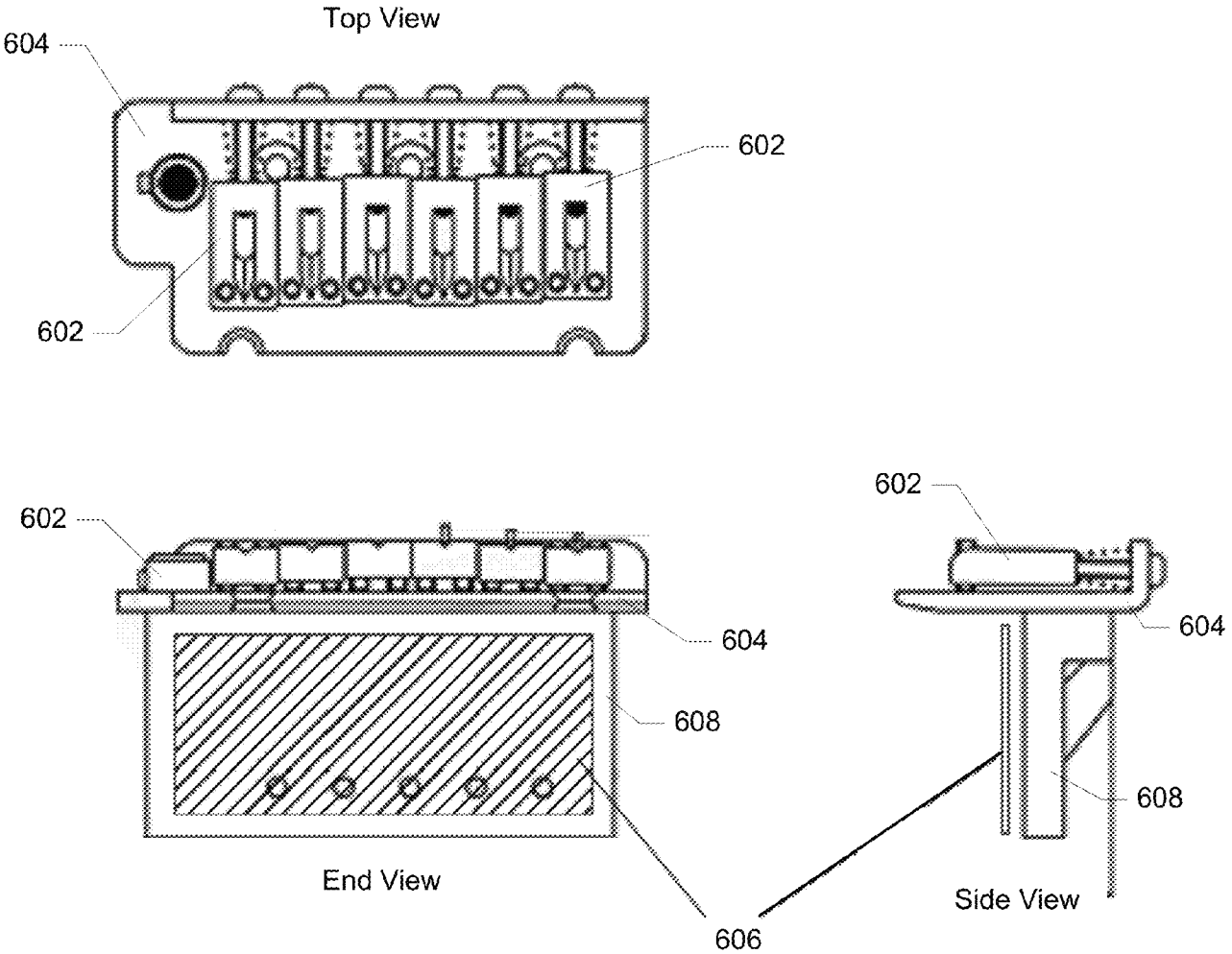
FIG. 6 illustrates a plurality of combined pickup/sustainers mounted on a bridge of a stringed instrument.

FIG. 6 shows an example of a particular implementation in which six combined sustainer/pickup components 602 are mounted on the bridge 604 of a Stratocaster style electric guitar. A printed circuit board assembly PCBA 606 (e.g., including the DSP and/or codecs of the signal processing chain such as the one shown in FIG. 5) may be attached to either the front or the back of the Stratocaster's spring plate 608 which is oriented at a right angle to the bridge and extends into the body of the guitar. Such an approach may be advantageous in that it may reduce the number of conductors external to the guitar that might otherwise be required to achieve the pickup and sustain functions described herein. That is, according to some implementations, each string might have 4 or 5 associated conductors connected to the signal processing chain. This could mean up to 30 conductors that would need to be routed off the guitar if the signal processing chain were located remotely. By contrast, the approach depicted in FIG. 6 may be implemented such that only four conductors leave the bridge, i.e., power, ground, serial data in, and serial data out.

While the invention has been particularly shown and described with reference to specific embodiments thereof, it will be understood by those skilled in the art that changes in the form and details of the disclosed embodiments may be made without departing from the spirit or scope of the invention. For example, although implementations have been described in which both a piezoelectric pickup and a sustainer are part of an integrated solution, implementations are contemplated in which each is implemented without the other.

In another example, an implementation is described above in which a pickup output is used to drive an electromagnet to create a sustain. However, implementations are contemplated in which the roles of these transducers are reversed, and the electromagnet acts as the pickup while the sustain is driven by the piezoelectric element. Also contemplated are implementations that use a single transducer, either piezoelectric or electromagnetic, where the transducer is alternately sampled and then driven at frequencies above the audio range.

In another example, implementations are contemplated in which the primary mode of a string's vibration may not be substantially parallel to the top plane or face of the instrument. In such implementations, the flexing beam of the saddle component may be oriented to capture the vibration mode(s) of interest.

In yet another example, the techniques described herein are not limited to providing a drive to a sustainer only for the purpose of sustaining a string's vibration. That is, sustainer components as described herein may be driven (e.g., using a signal processing chain as described above with reference to FIG. 5) to achieve any of a wide variety of effects. One example given above relates to driving the sustainer component to achieve the suppression of false harmonics. Other examples include damping a string's vibration, modulating a string's vibration to achieve specific harmonics or distortion of the fundamental and/or harmonics, or modulating the loudness of the string for a tremolo style result. Other effects will be apparent to those of skill in the art and are within the scope of the present application.

Finally, although various advantages, aspects, and objects of the present invention have been discussed herein with reference to various embodiments, it will be understood that the scope of the invention should not be limited by reference to such advantages, aspects, and objects. Rather, the scope of the invention should be determined with reference to the appended claims.

What is claimed is:

1. A saddle component for mounting on a surface of a stringed instrument and securing an end of a string of the stringed instrument, the saddle component comprising a body having a cantilevered structure extending therefrom, the cantilevered structure being configured to receive the string and to mechanically vibrate with a primary mode of vibration of the string in a direction parallel to the surface of the stringed instrument, the cantilevered structure further comprising a piezoelectric element oriented such that a primary planar orientation of the piezoelectric element is substantially perpendicular to the surface of the stringed instrument and substantially parallel to the string, the saddle component further comprising a permanent magnet in the cantilevered structure, and an electromagnet configured to interact with the permanent magnet to cause corresponding mechanical motion of the cantilevered structure.

2. The saddle component of claim 1, further having a signal processor associated therewith configured to receive an electrical signal generated by the piezoelectric element and generate a drive signal for the electromagnet responsive to the electrical signal.

3. The saddle component of claim 1, wherein the piezoelectric element is disposed within a corresponding slot in the cantilevered structure.

4. The saddle component of claim 1, wherein the piezoelectric element is the cantilevered structure.

5. The saddle component of claim 1, wherein the piezoelectric element is a bimorph piezoelectric element.

6. A saddle component for mounting on a surface of a stringed instrument and securing an end of a string of the stringed instrument, the saddle component comprising a body having a cantilevered structure extending therefrom, the cantilevered structure being configured to receive the string and to mechanically vibrate with a primary mode of vibration of the string in a direction parallel to the surface of the stringed instrument, the cantilevered structure further comprising a piezoelectric element oriented such that a primary planar orientation of the piezoelectric element is substantially perpendicular to the surface of the stringed instrument and substantially parallel to the string, the saddle component, further comprising a permanent magnet in the cantilevered structure, and an electromagnet, wherein a magnetic field of the permanent magnet interacts with the electromagnet during mechanical motion of the cantilevered structure, thereby causing the electromagnet to generate an electrical signal.

7. The saddle component of claim 6, further having a signal processor associated therewith configured to receive the electrical signal generated by electromagnet and generate a drive signal for the piezoelectric element responsive to the electrical signal.

8. The saddle component of claim 6, wherein the piezoelectric element is disposed within a corresponding slot in the cantilevered structure.

9. The saddle component of claim 6, wherein the piezoelectric element is the cantilevered structure.

10. The saddle component of claim 6, wherein the piezoelectric element is a bimorph piezoelectric element.

11. A saddle component for mounting on a surface of a stringed instrument and securing an end of a string of the stringed instrument, the saddle component comprising a body having a cantilevered structure extending therefrom, the cantilevered structure being configured to receive the string and to mechanically vibrate with a primary mode of vibration of the string in a direction parallel to the surface of the stringed instrument, the cantilevered structure further comprising a piezoelectric element oriented such that a primary planar orientation of the piezoelectric element is substantially perpendicular to the surface of the stringed instrument and substantially parallel to the string, the saddle component further having a signal processor associated therewith configured to receive an electrical signal generated by the piezoelectric element and generate a drive signal for the piezoelectric element responsive to the electrical signal, thereby causing corresponding mechanical motion of the cantilevered structure.

12. The saddle component of claim 11, wherein the piezoelectric element is disposed within a corresponding slot in the cantilevered structure.

13. The saddle component of claim 11, wherein the piezoelectric element is the cantilevered structure.

14. The saddle component of claim 11, wherein the piezoelectric element is a bimorph piezoelectric element.

15. A transducer for converting mechanical vibration of a string of a stringed instrument to an electrical signal, the transducer comprising a body having a cantilevered structure extending therefrom, the cantilevered structure being configured to receive the string and to mechanically vibrate with a primary mode of vibration of the string, wherein the cantilevered structure comprises a piezoelectric element that is oriented such that a primary planar orientation of the piezoelectric element is substantially perpendicular to a plane defined by the primary mode of vibration of the string, and substantially parallel with the string, the piezoelectric element being configured to generate the electrical signal in response to the vibration of the string and the cantilevered structure, the transducer further comprising a permanent magnet in the cantilevered structure, and an electromagnet configured to interact with the permanent magnet to cause corresponding mechanical motion of the cantilevered structure.

16. The transducer of claim 15, further having a signal processor associated therewith configured to receive the electrical signal generated by the piezoelectric element and generate a drive signal for the electromagnet responsive to the electrical signal, thereby causing the corresponding mechanical motion of the cantilevered structure.

17. The transducer of claim 15, wherein the piezoelectric element is disposed within a corresponding slot in the cantilevered structure.

18. The transducer of claim 15, wherein the piezoelectric element is the cantilevered structure.

19. The transducer of claim 15, wherein the piezoelectric element is a bimorph piezoelectric element.

20. A transducer for converting mechanical vibration of a string of a stringed instrument to an electrical signal, the transducer comprising a body having a cantilevered structure extending therefrom, the cantilevered structure being configured to receive the string and to mechanically vibrate with a primary mode of vibration of the string, wherein the cantilevered structure comprises a piezoelectric element that is oriented such that a primary planar orientation of the piezoelectric element is substantially perpendicular to a plane defined by the primary mode of vibration of the string, and substantially parallel with the string, the piezoelectric element being configured to generate the electrical signal in response to the vibration of the string and the cantilevered structure, the transducer further having a signal processor associated therewith configured to receive the electrical signal generated by the piezoelectric element and generate a drive signal for the piezoelectric element responsive to the electrical signal, thereby causing corresponding mechanical motion of the cantilevered structure.

21. The transducer of claim 20, wherein the piezoelectric element is disposed within a corresponding slot in the cantilevered structure.

22. The transducer of claim 20, wherein the piezoelectric element is the cantilevered structure.

23. The transducer of claim 20, wherein the piezoelectric element is a bimorph piezoelectric element.

24. A sustain component for mounting on a surface of a stringed instrument and securing an end of a string of the stringed instrument, the sustain component comprising a body having a cantilevered structure extending therefrom, the cantilevered structure being configured to receive the string and to mechanically vibrate with a primary mode of vibration of the string in a direction parallel to the surface of the stringed instrument, the sustain component further comprising a permanent magnet in the cantilevered structure, and an electromagnet configured to interact with the permanent magnet to cause corresponding mechanical motion of the cantilevered structure to sustain the primary mode of vibration of the string.

25. The sustain component of claim 24, further having a signal processor associated therewith configured to receive an electrical signal generated by the electromagnet and generate a drive signal for the electromagnet responsive to the electrical signal, thereby causing the corresponding mechanical motion of the cantilevered structure.

26. A saddle component for mounting on a surface of a stringed instrument and securing an end of a string of the stringed instrument, the saddle component comprising a body having a cantilevered structure extending therefrom in a direction that is substantially parallel to both the surface of the stringed instrument and the string, the cantilevered structure being configured to receive the string and to mechanically vibrate with a primary mode of vibration of the string in a direction parallel to the surface of the stringed instrument, the cantilevered structure further comprising a piezoelectric element oriented such that a primary planar orientation of the piezoelectric element is substantially perpendicular to the surface of the stringed instrument and substantially parallel to the string, further comprising a permanent magnet in the cantilevered structure, and an electromagnet configured to interact with the permanent magnet to cause corresponding mechanical motion of the cantilevered structure.

27. The saddle component of claim 26, wherein a magnetic field of the permanent magnet interacts with the electromagnet during mechanical motion of the cantilevered structure, thereby causing the electromagnet to generate an electrical signal.

28. The saddle component of claim 27, further having a signal processor associated therewith configured to receive the electrical signal generated by electromagnet and generate a drive signal for the piezoelectric element responsive to the electrical signal.

29. The saddle component of claim 26, further having a signal processor associated therewith configured to receive an electrical signal generated by the piezoelectric element and generate a drive signal for the electromagnet responsive to the electrical signal.

30. The saddle component of claim 26, further having a signal processor associated therewith configured to receive an electrical signal generated by the piezoelectric element and generate a drive signal for the piezoelectric element responsive to the electrical signal, thereby causing corresponding mechanical motion of the cantilevered structure.

31. The saddle component of claim 26, wherein the piezoelectric element is disposed within a corresponding slot in the cantilevered structure.

32. The saddle component of claim 26, wherein the piezoelectric element is the cantilevered structure.

33. The saddle component of claim 26, wherein the piezoelectric element is a bimorph piezoelectric element.

* * * * *